US008267518B2

(12) United States Patent
Welch et al.

(10) Patent No.: US 8,267,518 B2
(45) Date of Patent: Sep. 18, 2012

(54) SYSTEMS AND METHODS FOR ALTERING VISUAL ACUITY

(75) Inventors: Ashley J Welch, Burnet, TX (US); Rebecca L. Vincelette, Cibolo, TX (US); Henry Grady Rylander, III, Round Rock, TX (US); Thomas E. Milner, Austin, TX (US)

(73) Assignee: The Board of Regents, The University of Texas System, Auston, TX (US)

( * ) Notice: Subject to any disclaimer, the term of this patent is extended or adjusted under 35 U.S.C. 154(b) by 218 days.

(21) Appl. No.: 12/692,333

(22) Filed: Jan. 22, 2010

(65) Prior Publication Data

US 2010/0237258 A1 Sep. 23, 2010

Related U.S. Application Data

(60) Provisional application No. 61/250,719, filed on Oct. 12, 2009, provisional application No. 61/147,010, filed on Jan. 23, 2009.

(51) Int. Cl.
*A61B 3/10* (2006.01)
*A61B 3/14* (2006.01)

(52) U.S. Cl. ..... 351/211; 351/206; 351/205

(58) Field of Classification Search ..... 351/200–246
See application file for complete search history.

(56) References Cited

U.S. PATENT DOCUMENTS

| | | | | |
|---|---|---|---|---|
| 6,883,362 | B2 * | 4/2005 | Ogawa | 73/1.86 |
| 7,360,894 | B2 * | 4/2008 | Hirohara | 351/205 |
| 7,441,900 | B2 * | 10/2008 | Mihashi et al. | 351/239 |
| 7,869,627 | B2 * | 1/2011 | Northcott et al. | 382/117 |

FOREIGN PATENT DOCUMENTS

| | | |
|---|---|---|
| CA | 2647245 | 11/2007 |
| WO | 0182791 | 11/2001 |
| WO | 2008089063 | 7/2008 |

OTHER PUBLICATIONS

International Search Report and Written Opinion of International Application No. PCT/US2010/021814. Korean Intellectual Property Office. Dated Aug. 25, 2010.

(Continued)

*Primary Examiner* — Mohammed Hasan
(74) *Attorney, Agent, or Firm* — McKeon, Meunier, Carlin & Curfman, LLC

(57) ABSTRACT

Provided are systems operable to effect a temporary change in a modulation transfer function (MTF) of a target imaging system. The systems include a light source operable to produce light for transient propagation onto at least a portion of the target imaging system, a power source in operative communication with the light source and configured to effect the production of light from the light source, and a transmission unit in operative communication with the light source and configured to propagate the produced light onto at least a portion of the target imaging system. The propagated light is configured for absorbance by the portion of the target imaging system; the absorbance causes an increase in temperature and a change in a refractive index profile of at least the portion of the imaging system. The change in refractive index profile produces a temporary change in the MTF of the imaging system.

19 Claims, 14 Drawing Sheets

OTHER PUBLICATIONS

Handheld StunRay Filling the Gap in Less Lethal & Non-Lethal Capability StunRay Non-Lethal & Less Lethal Incapacitator. pp. 1-3. Copyright 2008 Genesis Illumination Inc, printed Jun. 7, 2009.
Stun Ray XL-2000 Tri-Mode Optical Incapacitator and Specifications. www.genesis-illumination.com. Copyright 2009 Genesis Illumincation, Inc.
Thomas, R. et al., "Propagation Effects in the Assessment of Laser Damage Threshold to the Eye and Skin," In Proc. of SPIE 6435 (SPIE, 2007), A1-12.
Thomas, R. et al., "A First-Order Model of Thermal Lensing of Laser Propagation in the Eye and Implications for Laser Safety," International Laser Safety Conference: 147-154 (2005).
Vincelette, R. et al., "A comparison of a first-order thermal lensing model to a closed aperture z-scan for the propagation of light in ocular media.," Optical Interactionswith Tissue and Cells XVII 6084(1), p. 60840G, SPIE, 2006.
Vincelette, R. et al., "Thermal Lensing in the Ocular Media," in Optical Interactions in Biomedical Optics and Imaging, vol. 8, No. 2, Optical Interactions With Tissue and Cells XVIII, (Jacques, S.L. and Roach, W.P. Editors) SPIE vol. 6435, pp. 64350C-1 to 64350C-7, San Jose, CA, Jan. 22-24, 2007.
Vincelette, R. et al., "Thermal lensing in ocular media exposed to continuous-wave near-infrared radiation: the 1150-1350-nm region," J Biomed Opt. Sep.-Oct. 2008;13(5):054005.
Vincelette, R. "Continuous-Wave Near-Infrared Laser Tissue Interaction in the Eye," Presentation. Oct. 16, 2008.
Vincelette, R. et al., "Thermal lensing from near-infrared laser radiation in an artificial eye," Optical Interactions with Tissue and Cells XX. Edited by Jacques, Steven L.; Jansen, E. Duco; Roach, William P.. Proceedings of the SPIE, vol. 7175 (2009)., pp. 71750I-71750I-9 (2009).
Vincelette, R. et al., "A first-order model of thermal lensing in a virtual eye," JOSA A, vol. 26, Issue 3, pp. 548-558 (2009).
Vincelette, R. "Thermal Lensing from Near-Infrared Laser Radiation in an Artificial Eye," Presentation. SPIE BiOS. Jan. 26, 2009.
Vincelette, R. et al., "Confocal imaging of thermal lensing induced by near-infrared laser radiation in an artificial eye," Selected Topics in Quantum Electronics, IEEE Journal of, Jul.-Aug. 2010, vol. 16, Issue 4. pp. 740-747.
Vincelette, R. et al., "Method for measuring ocular aberrations induced by thermal lensing in vivo," Optical Interactions with Tissues and Cells XXI. Edited by Jansen, E. Duco; Thomas, Robert J. Proceedings of the SPIE, vol. 7562, pp. 75620T-75620T-11 (2010).

* cited by examiner

SYSTEMS AND METHODS FOR ALTERING VISUAL ACUITY

CROSS-REFERENCE TO RELATED APPLICATIONS

This application claims the benefit of priority to U.S. Patent Application No. 61/147,010, entitled "Non-ionizing Radiation to Temporarily Change The Index of Refraction of Biological Tissues," which was filed on Jan. 23, 2009, and to U.S. Patent Application No. 61/250,719, entitled "Systems and Methods for Altering a Modulation Transfer Function of An Imaging System," which was filed on Oct. 12, 2009. The disclosure of the foregoing applications are incorporated herein by reference in their entirety.

TECHNICAL FIELD

This disclosure relates to light transmission systems and response of the eye to light.

BACKGROUND

Altering visual acuity can be an effective and non-invasive method of inhibiting an advancing subject. Techniques for doing so can include shining visible light, for example, from a laser source, into the eyes of the subject. The eyes however are susceptible to severe and permanent damage if the energy of the light that enters the eye is beyond threshold exposure levels.

SUMMARY

This specification describes technologies relating to optical techniques for altering visual acuity of eyes.

A system operable to effect a temporary change in a modulation transfer function (MTF) of a target imaging system is provided. The system includes a light source operable to produce light for transient propagation onto at least a portion of the target imaging system. The system further includes a power source in operative communication with the light source and configured to effect the production of light from the light source. The system further includes an optical system in operative communication with the light source and configured to propagate the produced light onto at least a portion of the target imaging system, wherein the propagated light is absorbed by the portion of the target imaging system, the absorbance causing an increase in temperature and a change in a refractive index profile of at least the portion of the imaging system, the change in refractive index profile producing a temporary change in the MTF of the imaging system.

The imaging system can optionally be an eye, such as a human eye. The absorption of light can disrupt visual acuity of the subject having the eye.

The wavelength of the propagated light can be between 1100 nm and 2500 nm. Optionally, the wavelength of the propagated light can be between 1100 nm and 1700 nm. For such a wavelength band, an irradiance of the propagated light at a location where the target imaging system receives the propagated light can be between 0.001 W/cm$^2$ and 500 W/cm$^2$. Alternatively, the irradiance of the propagated light at a location where the target imaging system receives the propagated light can be between 0.005 W/cm$^2$ and 50 W/cm$^2$. Alternatively, the irradiance of the propagated light at a location where the target imaging system receives the propagated light is between 0.1 W/cm$^2$ and 5 W/cm$^2$. The light source can be a first laser.

The system can further comprise a second light source, typically a laser, that generates light that is co-aligned with light from the first laser. The wavelength of the second propagated light can be between 450 nm to 650 nm. An irradiance of the second laser at a location where the target imaging system receives the propagated light can be greater than 0.001 mW/cm$^2$.

The portion of the imaging system that absorbs the propagated light can be anterior to photosensing element(s) of the imaging system. When the imaging system is an eye, the portion of the eye that absorbs the light can be anterior to the retina. The portion of eye that absorbs the light can be selected from the group consisting of the vitreous humor, the lens, the aqueous humor, and the cornea for infrared wavelengths. The absorption of light can cause a non-uniform index of refraction anomaly in the cornea, aqueous humor, lens or vitreous humor.

The system can further comprise additional visible and/or infrared light sources that produce light that is co-aligned with light produced by the first light source.

In general, one aspect of the subject matter described here can be implemented as a system operable to effect a temporary change in a modulation transfer function (MTF) of a target imaging system. The system includes a light source operable to produce light for transient propagation onto at least a portion of the target imaging system. A power source is in operative communication with the light source and is configured to effect the production of light from the light source. A transmission unit is in operative communication with the light source and is configured to propagate the produced light onto at least a portion of the target imaging system. The propagated light is configured for absorbance by the portion of the target imaging system. The absorbance causes an increase in temperature and a change in a refractive index profile of at least the portion of the imaging system. The change in refractive index profile produces a temporary change in the MTF of the imaging system.

This, and other aspects, can include one or more of the following features. The propagated light can have a wavelength in the range of 1100 nanometers (nm) to 2500 (nm), including any wavelength with in this range or any subset of ranges within this range. For example, a wavelength within a range of 1200 nm 2500 nm or 1300 nm to 2500 nm is included. The imaging system can be an eye. The portion of eye that absorbs the light can be anterior to the retina. The portion of the eye that absorbs the light can be selected from the group consisting of the vitreous humor, the lens, the aqueous humor, and the cornea. The absorption of light can cause a non-uniform index of refraction change in the cornea, aqueous humor, lens or vitreous humor. The portion of the eye that absorbs the light can be the retina or tissue posterior to the retina. The absorption of light can disrupt visual acuity. The eye can be a human eye. An irradiance of the propagated light at a location where the target imaging system receives the propagated light can be between 0.001 W/cm$^2$ and 500 W/cm$^2$. An irradiance of the propagated light at a location where the target imaging system receives the propagated light can be between 0.005 W/cm$^2$ and 50 W/cm$^2$. An irradiance of the propagated light at a location where the target imaging system receives the propagated light can be between 0.1 W/cm$^2$ and 5 W/cm$^2$. The light source can be a first laser light source. The system can further include a second light source operable to produce light for transient propagation onto at least a portion of the target imaging system. The transmission unit can be in operative communication with the second light source and can be configured to propagate light produced by the second light source onto at least a portion of the target imaging system. The propagated light from the second light source can have a wavelength in the range of 450 nm to 650 nm. The transmission unit can be operable to co-align light from the first and second light sources for propagation onto at least a portion of the target. An irradiance of the second laser at a location where the target imaging system receives the propagated light can be greater than 0.001 $mW/cm^2$.

Another aspect of the subject matter described here can be implemented as a system to temporarily alter visual acuity of a subject. The system includes a first light source configured to produce infrared light in an infrared wavelength spectrum for transient propagation into an eye of the subject. A second light source is configured to produce visible light in a visible wavelength spectrum for transient propagation into the eye of the subject. A transmission unit is configured to propagate the infrared light and the visible light into the eye. The light propagated into the eye temporarily alters visual acuity of the subject.

This, and other aspects, can include one or more of the following features. The first light source can be configured to produce the infrared light having a first irradiance sufficient to cause temperature gradients in the eye. The temperature gradients can cause changes in a refractive index profile in the eye. The second light source can be configured to produce the visible light at a second irradiance sufficient to saturate light receptors in the eye. The saturation of receptors can modify the functional MTF of the imaging system, such as an eye. The transmission unit can include an optical system configured to co-align the infrared light and the visible light. The optical system can be configured to produce a co-aligned infrared light and visible light with a spot size of about 10 cm to 2.0 m at a target distance of about 500 meters (m). The first light source can produce infrared light in a wavelength range of 1100 nm to 2500 nm. The first light source can produce infrared light in a wavelength range of 1100 nm to 1700 nm. The first light source can produce infrared light having a wavelength of about 1318 nm. The second light source can produce visible light in a wavelength range of 450 nm to 650 nm. The second light source can produce visible light having a wavelength of about 535 nm. The transmission unit can be configured to propagate the infrared light and visible light for a distance greater than 2 km before entering the eye. The transmission unit can be configured to propagate the infrared light and visible light for a distance of about 100 m before entering the eye. The transmission unit can be configured to propagate the infrared light and visible light for a distance of about 10 m before entering the eye. At least one additional light source can be configured to produce infrared light in an infrared wavelength spectrum for transient propagation into the eye. The infrared wavelength of the infrared light produced by the first light source can be different from the infrared wavelength of the infrared light produced by the at least one additional light source. At least one additional light source can be configured to produce visible light in visible wavelength spectrum for transient propagation into the eye. The visible wavelength of the visible light produced by the at least one additional light source can be different from the visible wavelength of the visible light produced by the second light source.

Another aspect of the subject matter described here can be implemented as a method for altering visual acuity of a subject. Visible light in a visible wavelength spectrum is propagated into the eye. The visible light generates glare at a glare angle. An area of the retina on which the visible light is incident is related to the glare angle. The propagated visible light is modified to increase the glare angle. An area of the retina on which the modified visible light is incident is greater than the area of the retina on which the propagated visible light is incident. The modified visible light alters visual acuity of the subject.

This, and other aspects, can include one or more of the following features. A power required to propagate the modified visible light can be less than a power required to propagate the visible light that is not modified. The visible light can be a laser having a retinal spot size. Modifying the visible light to increase the glare angle can increase the retinal spot size of the visible laser. Modifying the visible light can include propagating an infrared light in an infrared wavelength spectrum, co-aligning the infrared light with the visible light to form co-aligned light, and propagating the co-aligned light into the eye. The visible light can have an irradiance sufficient to saturate the receptors in the portion of the eye on which the visible light is incident. The infrared light can have an irradiance sufficient to cause a temperature gradient at the portion of the eye. The temperature gradient can cause a change in a refractive index profile of the portion of the eye. The visible light can be incident on the retina, and the infrared light can cause the temperature gradient at a region anterior to the retina.

Another innovative aspect of the subject matter can be implemented as a method for temporarily altering the visual acuity of a subject. The method includes projecting infrared wavelength light into an eye of the subject, and projecting visible wavelength light into the eye of the subject, wherein the infrared wavelength light and visible wavelength light temporarily alter visual acuity of the subject.

This, and other aspects, can include one or more of the following features. The infrared wavelength light can be projected in co-alignment with the projected visible wavelength light.

Particular embodiments of the subject matter described in this specification can be implemented so as to realize one or more of the following potential advantages. When light having a wavelength in a visible light spectrum is propagated onto an eye, for example, an eye of a human subject, the resulting glare can alter visual acuity of the system. When light having a wavelength in the infrared light spectrum is propagated onto the eye, the resulting change in refractive index of the eye can also alter visual acuity. When light from the two sources (infrared and visible) are combined, the combined light can spread the glare across a larger portion of the eye increasing the glare angle which, in turn, can further alter the visual acuity. Further, the combined light can decrease the glare at a portion of the eye by spreading the glare to other portions of the eye, and can thereby decrease a possibility of permanent damage to the eye. By altering visual acuity, the approach of an oncoming target can be inhibited.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
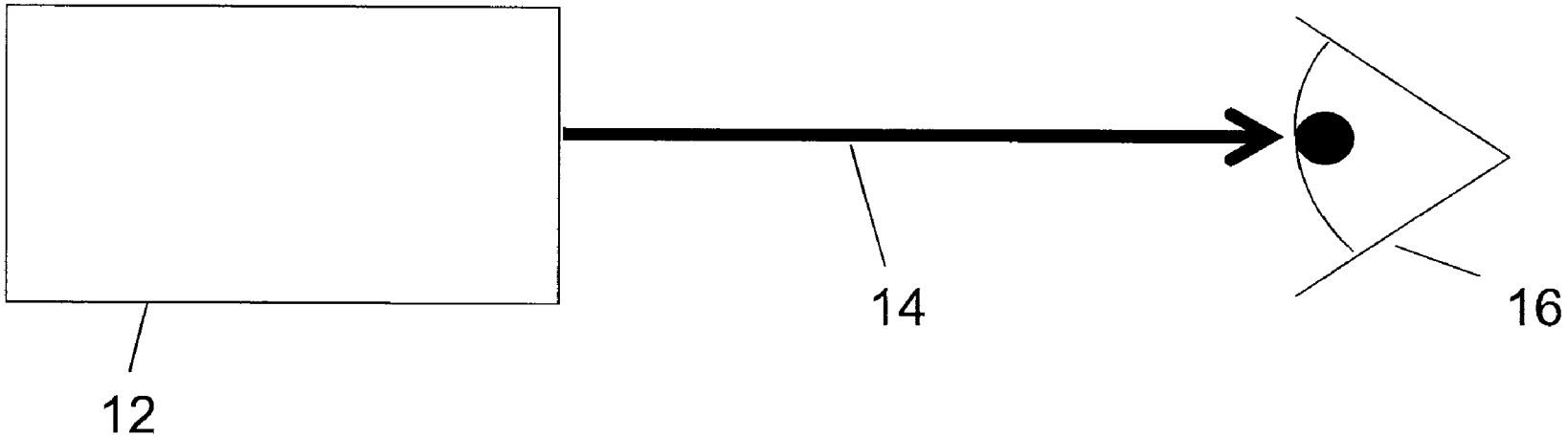
FIG. 1 is a block diagram of an example system operable to effect a temporary change in visual acuity of a target.

Provided herein are systems and methods operable to effect a temporary change in a modulation transfer function (MTF) of a target imaging system. The modular transfer function (MTF) is a measure of the capability of an imaging system, for example, the eye, to reproduce an image of an object. The target imaging system can be an eye of an animal, such as a human.

The methods and systems can be used to cause a temporary disruption of visual acuity in the eye. The temporary change in visual acuity may be desirable to temporarily disable the target subject for security, law enforcement, protection, or military reasons.

Moreover, the methods and systems can be used to increase the retinal spot size of non-lethal visual security devices (for example, dazzler devices). By increasing the retinal spot size, the systems and methods reduce the likelihood of permanent eye damage from using dazzler devices at too close of a range or at too high of a radiant light power.

An example system includes a light source operable to produce light for transient propagation onto at least a portion of the target imaging system. The system further includes a power source in operative communication with the light source and configured to effect the production of light from the light source. The system further includes an optical system in operative communication with the light source and configured to propagate the produced light onto at least a portion of the target imaging system. The propagated light can be absorbed by the portion of the target imaging system to cause an increase in temperature and a change in a refractive index profile of at least the portion of the imaging system. The change in refractive index profile can produce a temporary change in the MTF of the imaging system.

The imaging system can optionally be an eye, such as a human eye. The absorption of light can temporarily disrupt visual acuity of the subject having the eye.

The wavelength of the propagated light can be between 1100 nm and 2500 nm. For example, the wavelength of the propagated light can be between 1100 nm and 1700 nm.

For such a wavelength band, an irradiance of the propagated light at a location where the imaging system receives the propagated light can be between 0.001 W/cm$^2$ and 500 W/cm$^2$. Alternatively, the irradiance of the propagated light can be between 0.005 W/cm$^2$ and 50 W/cm$^2$. Alternatively, the irradiance of the propagated light is between 0.1 W/cm$^2$ and 5 W/cm$^2$. The location where the imaging system receives the propagated light can be the front surface of the target imaging system. For example, if the target imaging system is an eye, the front surface of the target imaging system can be the cornea.

The light source can be a first laser. The system can further comprise a second light source that can produce laser light that is co-aligned with the first laser light. The second laser can have a wavelength between 450 nm and 2500 nm. For example, the wavelength range can be in the visible spectrum, for example from 450 nm to 650 nm. The co-alignment can be along an axis or plane of projection towards a target. An irradiance of the second laser at a location where the imaging system transduces the imaged light can be greater than 0.001 mW/cm$^2$.

If the target imaging system is an eye, the portion of the eye that absorbs the light can be the retinal receptors and a portion anterior to the retina. The portion of eye anterior to the retina that absorbs the light can be selected from the group consisting of the vitreous humor, the lens, the aqueous humor, and the cornea. The absorption of visible light can cause glare. The absorption of infrared light can cause a non-uniform index of refraction anomaly in the cornea, aqueous humor, lens and/or vitreous humor.

FIG. 1 illustrates an example system 12 operable to effect a temporary change in a modulation transfer function (MTF) of a target imaging system, for example an eye 16. The beam of light 14 can have a wavelength between about 1100 nm and 2500 nm. Optionally, the wavelength is between 1100 nm and 1700 nm in air.

Light with a wavelength between 1100 nm and 1700 nm can be emitted into the pupil of an imaging system of, for example, a weapon system, surveillance system, human eye or another, animal's eye, herein denoted as a "target," to effect the temporary change in MTF. The light can cause a temporary change in the refractive index of one or more components of the imaging system. This temporary change in the refractive index can result in a temporary disruption in a visual acuity of the target imaging system.

Figure 2:
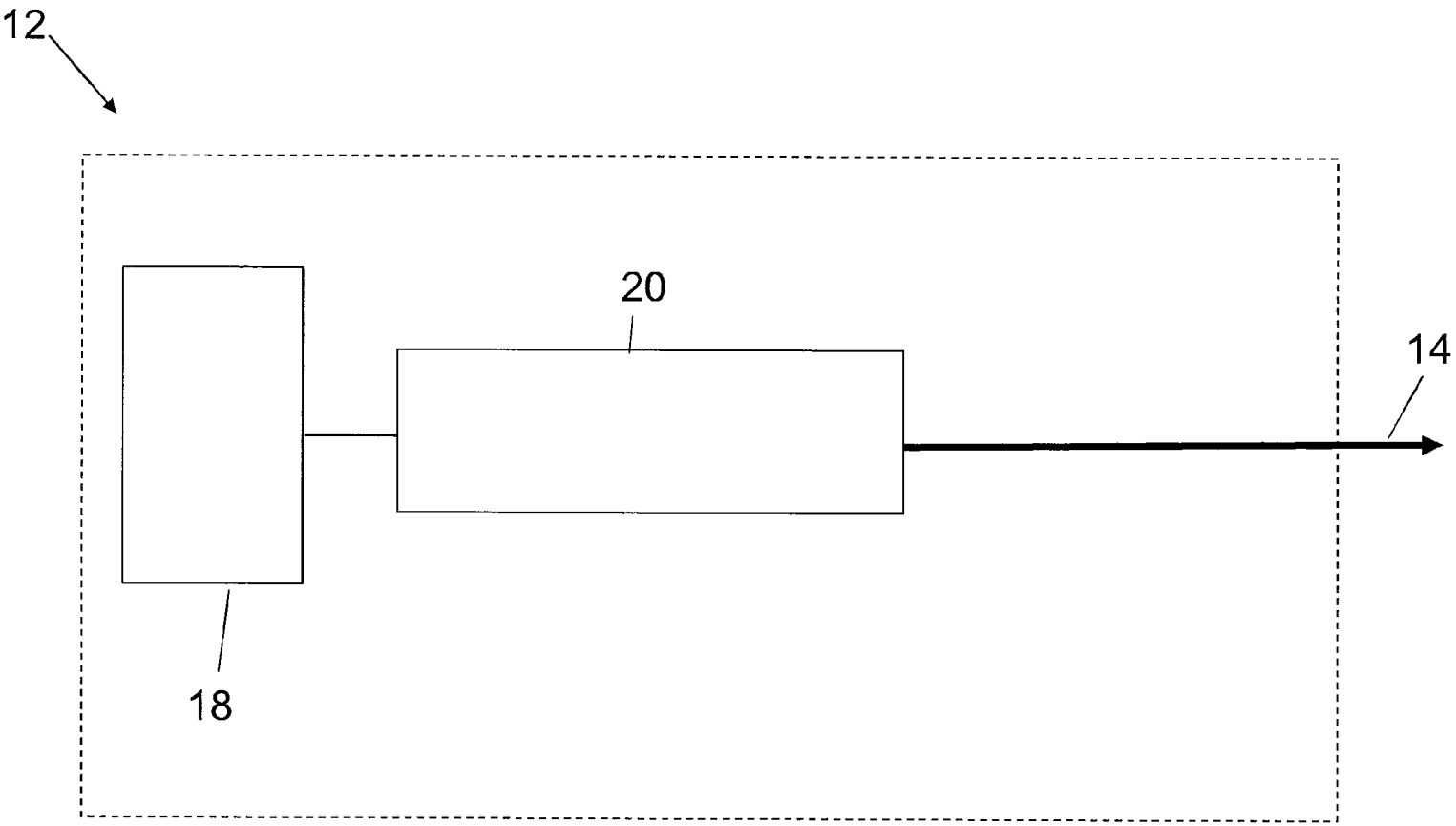
FIG. 2 is a block diagram of an example system operable to effect a temporary change in visual acuity of a target.

FIG. 2 illustrates an embodiment of an example system 12. System 12 includes a light source 20 configured to produce a light beam and a power source 18. The light source 20 emits light with a wavelength between about 1100 nm and about 1700 nm. The light source 20 can be a laser, although other light sources that produce light in the desired bandwidth, such as, for example, a Quartz Tungsten Halogen (QTH) lamp combined with a filter or filters, can be used as well.

Power characteristics of the light beam 14 can be adjusted and set to provide a temporary change in the MTF of an imaging system. The light beam 14 produced by light source 20 is optionally of a finite duration. For example, the duration can be between 1 fs and 20 seconds. In other examples, the light beam can be projected continuously.

The light causing a change in MTF can change the refractive index of at least a portion of the target imaging system. The refractive index change is related to a change in temperature in a portion of the imaging system. The change in temperature is related to the absorption coefficient of the components of the imaging system, such as the eye. The change in index of refraction can occur, for example, in a lens of the imaging system. However, the change in index of refraction of the lens may not change uniformly. Thus, the lens can have a non-uniform index of refraction related to a non-uniform change in temperature in the lens.

The power to generate light beam 14 is produced at power source 18. A feedback mechanism that monitors the power in light beam 14 may be used to control the power in order to ensure that the radiant power in light beam 14 is below a damage threshold for the imaging system. The feedback system functions by receiving as input the range of the target, determining the power at that range, and comparing with a threshold safety value.

Figure 3:
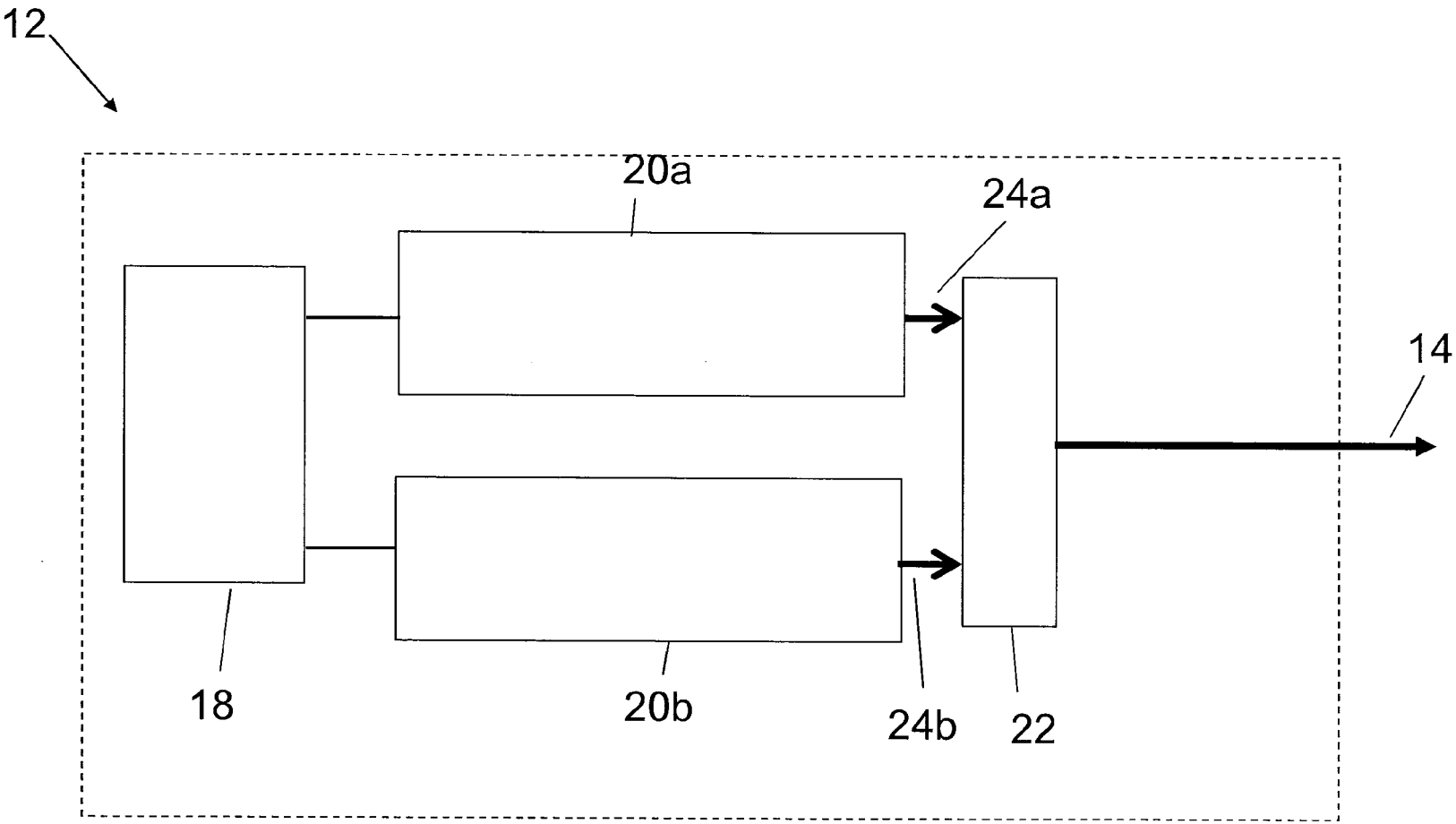
FIG. 3 is a block diagram of an example system operable to effect a temporary change in visual acuity of a target.

FIG. 3 illustrates an example embodiment of system 12. In this embodiment, along with power source 18, there are two light sources 20*a* and 20*b* and a co-aligning mechanism 22 to co-align the light produced by the two light sources 20*a* and 20*b*.

Co-aligned light from the light sources combine the benefit of two or more wavelengths to cause a temporary change in a visual acuity of the target. For example, if the light source 20*a* is a laser producing coherent light in the infrared spectrum, while light source 20*b* is a second laser producing coherent light in the visible spectrum, then the effect of co-aligning these beams is to produce a temporary halo in a line of vision of the target. Such a halo is effective in applications using a non-lethal security measure.

In this embodiment, the light source 20*a* produces a temporary change in the refractive index profile of at least one component in the optical imaging system. The second light source 20*b* is aimed and enters the pupil of the target imaging system and due to the change in refractive index profile produced by light beam 20*a*, is not focused on the imaging plane of the target imaging system (for example, retina). The light power of the defocused beam entering the imaging sensor of the imaging system such as the eye can be at a higher safe power than the beam. The defocused beam can cause perception of a halo, glare, or flash blindness effect in the eye.

Light sources 20*a* and 20*b* can produce coherent light beams 24*a* and 24*b* respectively. Coherent light beams 24*a* and 24*b* are then co-aligned using a co-alignment mechanism 22, which then co-aligns beams 24*a* and 24*b* to produce co-aligned beam 14. Power is monitored in the co-aligned beam by splitting off a small portion of the radiant power and directing it to an optical power metering element. The co-alignment of the two beams can be completed for example by a dichroic element that combines beams in transmission and reflection.

Figure 4:
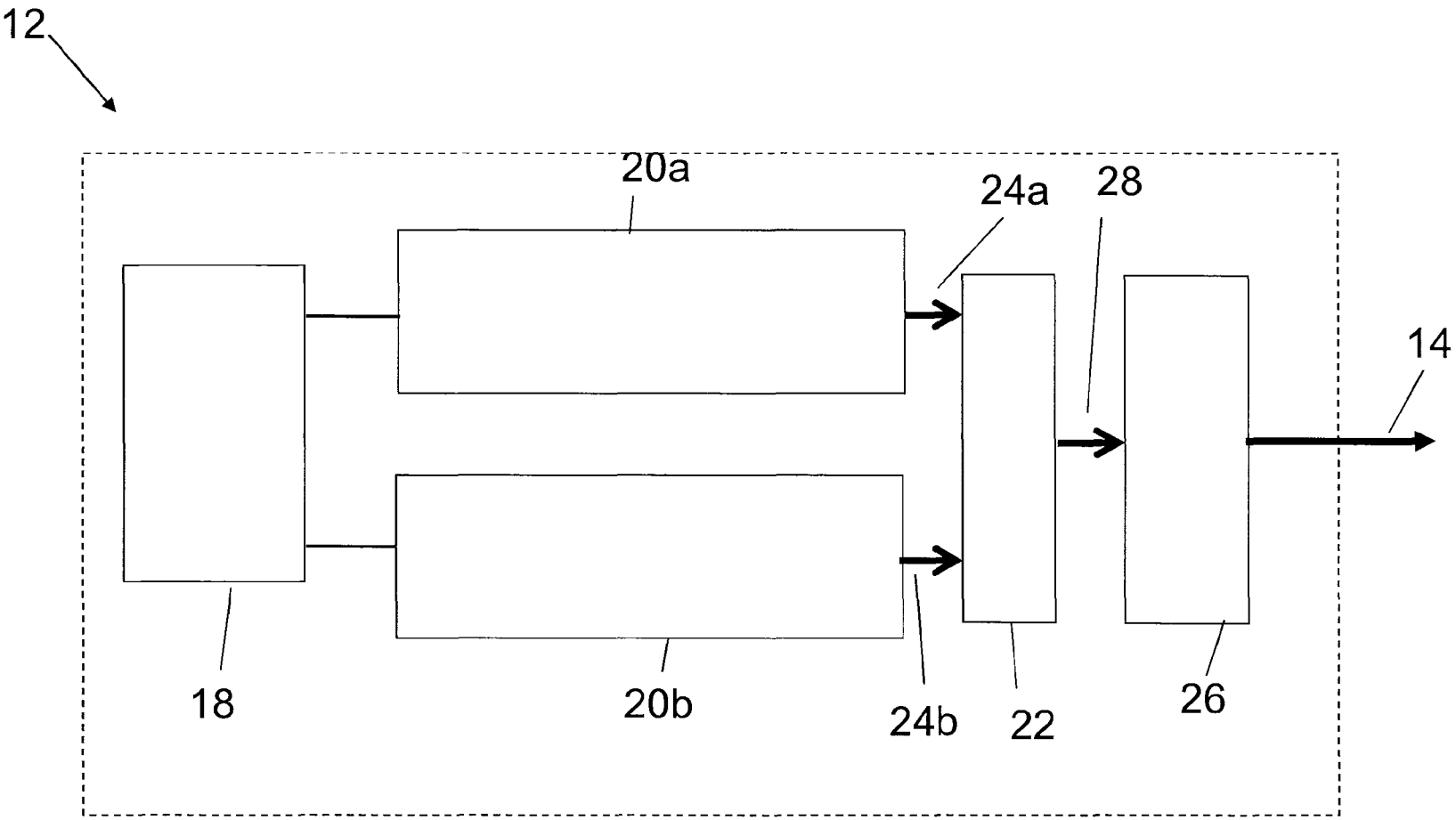
FIG. 4 is a block diagram of an example system operable to effect a temporary change in visual acuity of a target.

FIG. 4 illustrates another example embodiment. In this embodiment, system 12, in addition to power source 18 and light source 20, includes an optical system 26. Although FIG. 4 illustrates this embodiment with optical system 26 in addition to the features in the second embodiment of system 12 (i.e., co-aligned light produced by sources 20*a* and 20*b*), this need not be the case and optical system 26 can also be in addition to the features in the first embodiment (i.e., source 20).

The optical system 26 is operable to control a focus and a diameter of light beam 14. For example, a desired beam diameter at the target is between about 10 cm and about 2.0 m. A desired target distance is between about 1.0 meter and about 2000 meters from system 12. Depending on the application, other values of the beam diameter and target distance may be appropriate. A beam induces a temperature change produced by absorption of radiant energy which is determined by the absorption coefficient, irradiance of the beam ($J/cm^2$), and thermal properties of the target material. Control of the focus and diameter of light beam 14 can be accomplished manually or through the feedback mechanism monitoring the power in light beam 14.

The change in refractive index in the eye, or other target imaging system, is accomplished through an effect known as thermal lensing. The phenomenon is the result of a temperature gradient, typically assumed to be, but not limited to, radially symmetric, and formed by the absorption of laser light in the eye, or other imaging system. As the temperature, T, of the medium increases, the local density, p, decreases. This leads to a decrease in the index of refraction, n, resulting in the formation of a negative lens. The temperature gradient is shaped by the beam profile and the thermal diffusivity of the eye, or other material in the target imaging system.

In regard to an animal eye, the creation of a thermal lens in ocular media causes the spot size formed at the retina to change dynamically as a function of the coupled transient response of heat generated by absorption of the incident beam and thermal diffusion.

The combination of a temperature gradient in the eye and a temperature dependence on the index of refraction of the eye leads to a nonconstant index of refraction profile about an axis of symmetry of the eye. For example, a parabolic model of the index of refraction takes the following form:

$$n(r, T) = n_0 + \frac{r^2}{2}\left[\frac{\partial^2 T}{\partial r^2}\frac{\partial n}{\partial T}\right]_{r=0} \tag{1}$$

Here, $n_0$ is the value of the refractive index on the axis of symmetry, and r is the distance from the axis of symmetry.

The value of the quantity $$\frac{\partial^2 T}{\partial r^2}$$

on the axis of symmetry is found through a solution to the heat diffusion equation. Assuming that the coherent light beam incident on the target imaging system has a Gaussian profile:

$$S(r) = \frac{2\mu P}{\pi\omega^2}\exp\left(-2\frac{r^2}{\omega^2}\right), \tag{2}$$

where μ is the linear absorption coefficient of the material in the target imaging system, P is the power at a longitudinal position within the eye, and ω is the $1/e^2$ width of the beam, $$\frac{\partial^2 T}{\partial r^2}$$

on the axis of symmetry takes the following value:

$$\frac{\partial^2 T}{\partial r^2} = -\frac{8\eta\mu P}{\pi\kappa\omega^2}\frac{t}{8\eta t + \omega^2}, \tag{3}$$

where κ is the thermal conductivity of the eye and t is the exposure time of the light beam within the eye. Where the symbol η is thermal diffusivity.

Figure 11:
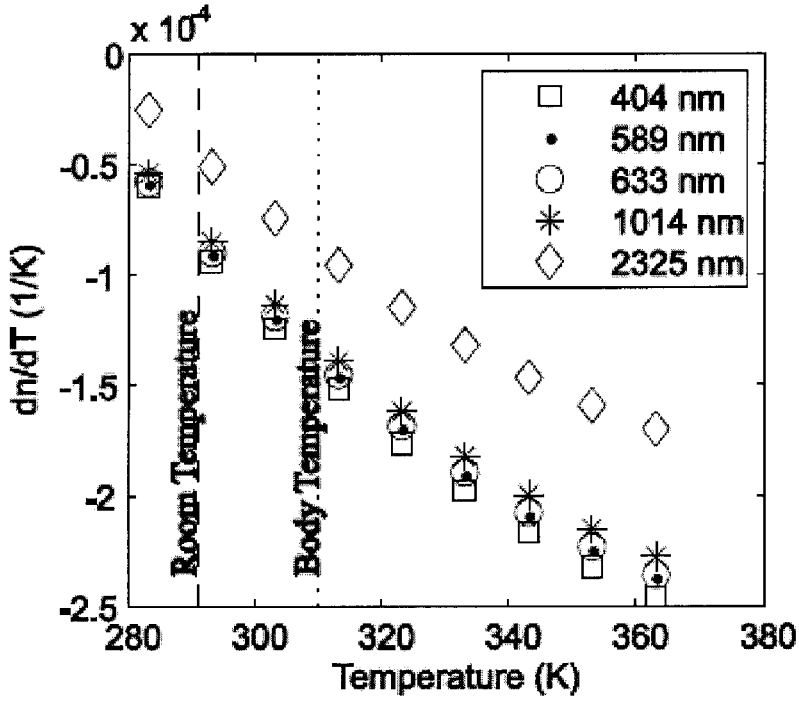
FIG. 11 is a plot of change in refractive index over a range of temperatures.

The value of $$\frac{\partial n}{\partial T}$$

on the axis of symmetry, or $$\frac{\partial n_0}{\partial T},$$

is determined empirically and, for animal eyes, from known data for water. Values of $$\frac{\partial n_0}{\partial T}$$

as a function of the temperature T for water in the liquid phase are presented in FIG. 11. Values of $$\frac{\partial n_0}{\partial T}$$

at room temperature for wavelengths within the desired bandwidth for imaging systems composed primarily of water were found using known empirical techniques.

Combining the computed values of $$\frac{\partial^2 T}{\partial r^2} \text{ and } \frac{\partial n}{\partial T}$$

on the axis of symmetry of the eye as prescribed in Eq. (1) determines the nonconstant behavior of the index of refraction of the eye due to exposure of the eye to the light beam.

Provided are systems and methods wherein light of a visible wavelength is used to cause a temporary change in visual acuity in a target subject, such as a human. For example, the visible wavelength light can have a wavelength of between about 450 nm to 650 nm. The systems and methods can further utilize light having an infrared wavelength in the range of 1100 nm to 2500 nm.

The light having the visible wavelength can be configured to cause a temporary disruption in visual acuity of the subject at a given distance X. For example, the distance X can optionally be 1000 meters. To achieve the disruption in visual acuity, the light may have characteristics that can cause permanent damage to the eye of the subject at a closer distance (X/n). In one optional example n can be 100. In other words, the irradiance at a location where the eye receives light to cause a temporary disruption of visual acuity at the further distance X may be above the retinal damage threshold of the eye at the closer distance X/n.

The light of the infrared wavelength can be transmitted to the same eye as the light of the visible wavelength concurrently with the visible light. The light having the infrared wavelength can expand the retinal spot size of the visible wavelength light and thereby reduce the risk of permanent damage at the closer distance X/n. If an unexpected target enters the beam at X/n, the range finder cuts or blocks power to all light sources to minimize the time the unexpected target is exposed to above intense light. The actual safety threshold increases as exposure time decreases. Optionally, the light having the infrared wavelength can be propagated at all times during the operation of the system and can therefore act as a safety measure if propagation of the light of the visible wavelength occurs at a distance of X/n which could result in permanent damage.

Further provided is a method of effecting a temporary change in a modulation transfer function (MTF) of a target imaging system, comprising directing a light beam into the target imaging system. At least a portion of the light is absorbed by a portion of the target imaging system, the absorbance causing an increase in temperature and a change in a refractive index profile of at least the portion of the imaging system, the change in refractive index profile producing a temporary change in the MTF of the target imaging system. Optionally the target imaging system is an eye such as a human eye. The change in the refractive index of one or more components of the imaging system can result in a nonconstant index of refraction profile about an axis of symmetry of the imaging system. The light beam can be a laser light beam which optionally has a wavelength of between 1100 nm and 2500 nm. The light beam can be co-aligned with a light beam that is in the visible light spectrum. In such scenarios, the infrared light beam modifies the optical MTF by causing variations in the index of refraction and the visible light beam modifies the functional MTF. The laser light beams can be of a predetermined beam diameter at a predetermined distance from the light source. The beam or beams can diverge as they leave the source and the system optics can be used to achieve a desired spot size at the target. Optionally, the focal distance is between about 1.0 meter to about 2000 meters. Optionally, the diameter of the light beams is between about 10 cm and 2.0 meters and the duration of the light beams is between about 1 femtosecond to about 20 seconds.

The method can further comprise comparing a power parameter of one or both of the light beams to a damage threshold of the target imaging system and adjusting or maintaining the power of one or both of the light beams to a level that is below the damage threshold of the target imaging system. Thus the irradiance at the selected target imaging system can be selected or adjusted to be below a damage threshold that could permanently damage the target imaging system, for example an eye.

In regard to the eye, a directed-energy system may be used that employs light directed at the eye, for example, a human eye. Optionally, the system produces co-aligned light that includes infrared light and visible light. The infrared light emitted by the system temporarily disrupts functional vision by safely altering the ability of the eye to focus images. The visible light results in a glare that produces an effect similar to temporary blindness. The augmentation of the visible light and the infrared light increases the glare angle and enhances an effect of altering, i.e., inhibiting visual acuity of the eye while decreasing harm, for example, permanent damage, to the eye. As described with reference to the figures that follow, some implementations of the system can employ a combination of lights of different wavelengths to either increase a spot size formed on the eye or to change properties of the eye that affect visual acuity or both.

Figure 5:
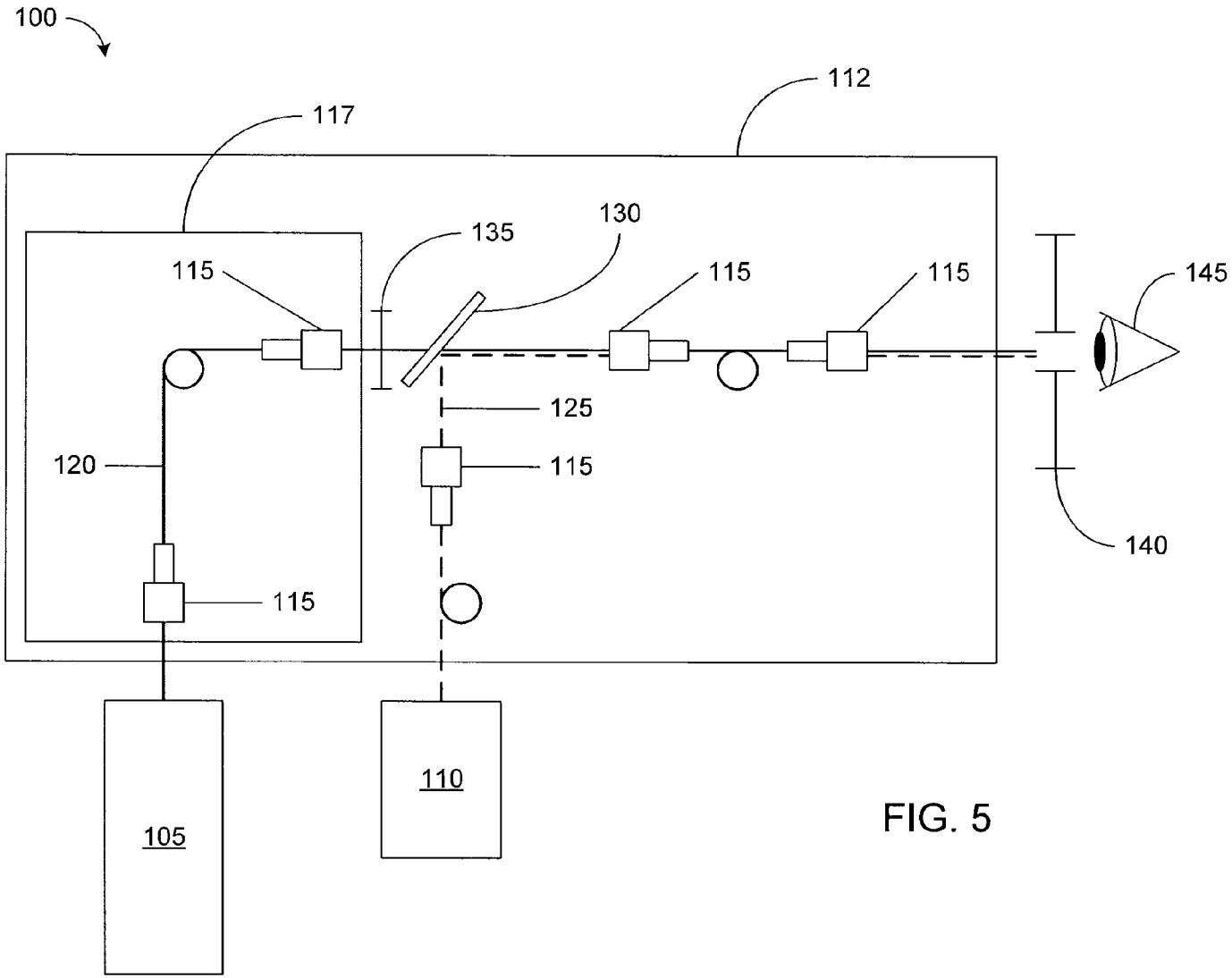
FIG. 5 is a schematic diagram showing an example system to temporarily alter visual acuity.

FIG. 5 is a schematic diagram showing an example system 100 to temporarily alter visual acuity. The system 100 includes a light source 105 to produce infrared light and a light source 110 to produce visible light. The system 100 further includes an example transmission unit 112. A transmission unit is configured to propagate light onto a target. A transmission unit can optionally propagate infrared light and/or visible light. A transmission unit can also optionally comprise other features as described here. Thus the transmission unit 112 and the other example transmission units described herein are examples of transmission units that can propagate optical energy onto a target.

The transmission unit 112 optionally combines the infrared light and the visible light, and propagates the combined infrared light and visible light onto all or a portion of an eye. The transmission unit 112 includes an optical system 117 that further includes multiple components to combine the infrared and visible lights. In some implementations, the optical system 117 can co-align the infrared and visible lights using optical components such as, for example, fiber collimators 115, and fiber optic cables, 120, 125. In some implementations, the optical system 117 can include a cold mirror 130 that has the property of transmitting infrared light and reflecting visible light.

In some implementations, the infrared light produced by the light source 105 is transmitted through fiber optic cables 120 and through fiber collimators 115 to be incident on a surface of the cold mirror 130. In some implementations, the transmission unit 112 can include a shutter 135 that can be controlled to close and open, for example, for a specified duration. When the shutter 135 is closed, the infrared light is not incident on the cold mirror 130 and vice versa. The visible light produced by the light source 110 is transmitted through fiber optic cables 125 to be incident on a surface of the cold mirror 130 that opposes the surface on which the infrared light is incident. The infrared light is transmitted through the cold mirror 130, the visible light is reflected by the cold mirror 130, and both lights are passed into a fiber collimator 115. The lights are combined, for example, co-aligned to generate co-aligned light that is transiently propagated to the eye 145, for example, through a slit lamp 140 that limits aperture. In some implementations, the eye 145 on which the co-aligned light is incident is an eye, for example, a human eye. The shutter can be moved to the other side of the cold mirror to block both light beams.

The infrared light alters visual acuity by causing a temperature gradient at the portion of the eye on which the light is incident. The temperature gradient causes a change in a refractive index profile of the eye.

As described above, the change in refractive index in the eye is accomplished through an effect known as thermal lensing. The phenomenon is the result of a temperature gradient, assumed to be radially symmetric, and formed by the absorption of laser light in the eye, or other imaging system. As the temperature, T, of the medium increases, the local density, p, decreases. This leads to a decrease in the index of refraction, n, resulting in the formation of a negative lens. The temperature gradient is shaped by the beam profile and the thermal diffusivity of the eye.

In regard to an animal eye, the creation of a thermal lens in ocular media causes the spot size formed at the retina to change dynamically as a function of the coupled transient response of heat generated by absorption of the incident beam and thermal diffusion. The combination of a temperature gradient in the eye and a temperature dependence on the index of refraction of the eye leads to a non-constant index of refraction profile about and along an axis of symmetry of the eye.

The portion of the eye that absorbs the infrared light may be anterior to the retina, for example, the vitreous humor, the lens, the aqueous humor, the cornea. As described previously, the change in the refractive index profile causes a non-uniform index of refraction change in the portion of the eye, which, in turn, disrupts visual acuity. In some implementations, the light source 105 is a laser source configured to produce infrared light having a wavelength in the range of 1100 nm to 2500 nm, optionally, in the range of 1100 nm to 1700 nm, for example, 1318 nm. In some implementations, the irradiance of the infrared light generated by the infrared light-generating laser is between 0.001 $W/cm^2$ and 500 $W/cm^2$, more specifically, for example, between 0.005 $W/cm^2$ and 50 $W/cm^2$, and/or 0.1 $W/cm^2$ and 5 $W/cm^2$ at the target.

The visible light saturates the light receptors in at least the portion of the eye on which the co-aligned light is incident, thereby producing an effect of temporary partial or complete blindness. In some implementations, the light source 110 is a laser source configured to produce visible light in the range of 450 nm to 650 nm, for example, 535 nm.

In some implementations, the irradiance of the visible light generated by the visible light-generating laser is greater than 0.001 $mW/cm^2$. It will be appreciated that more than one infrared light source and/or more than one visible light source can be coupled with the transmission unit 112 to produce the co-aligned light. An example of such a system is described with reference to FIG. 6.

Figure 6:
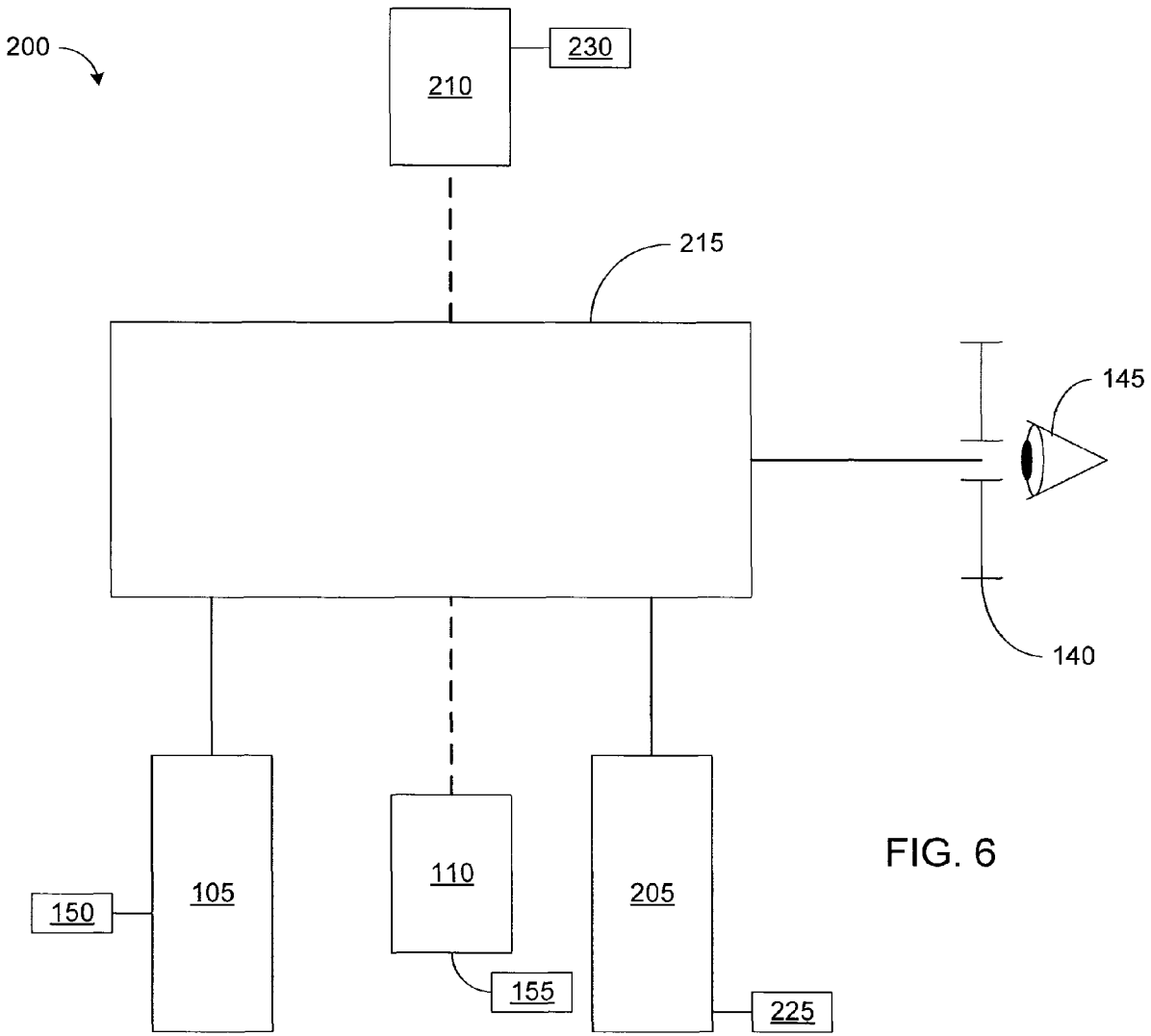
FIG. 6 is a schematic diagram showing an example system combining light from multiple light sources.

FIG. 6 is a schematic diagram showing an example system 200 combining light from multiple light sources. Similar to the example transmission unit 112, the example transmission unit 215 included in the system 200 is configured to combine light from multiple sources and propagate the combined light onto at least a portion of the eye.

In some implementations, in addition to being coupled to the infrared light source 105 and a visible light source 110, the transmission unit 215 can be coupled to another infrared light source 205 and another visible light source 210. Each of the light sources 105, 110, 205, and 210, can be operatively coupled to a corresponding power source 150, 155, 225, and 230, each of which is configured to provide power to cause the corresponding light source to produce and transmit light, for example, optical laser beams. In implementations in which multiple infrared light sources are coupled to the transmission unit, the time sequence of each infrared light source can be adjusted to customize changes of index of refraction as a function of depth in the eye.

The properties of visible light produced by laser source 110, for example, wavelength, irradiance, laser beam spot size, and the like, can be the same as or different from those produced by laser source 210. Similarly, the properties of infrared light produced by laser source 105, for example, wavelength, irradiance, laser beam spot size, and the like, can be the same as or different from those produced by laser source 205. By combining infrared light and visible light from different sources, co-aligned light having different properties can be generated for different applications, some of which are explained with reference to FIGS. 7A-7C.

Figure 7A:
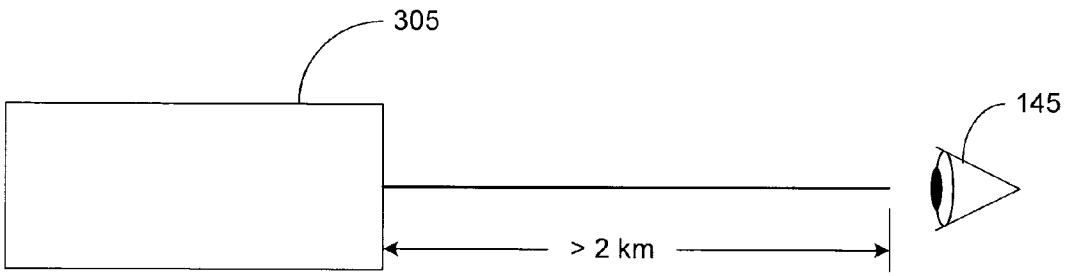
FIGS. 7A-7C are schematic diagrams showing example systems for propagating light to eyes at different distances.
Figure 7B:
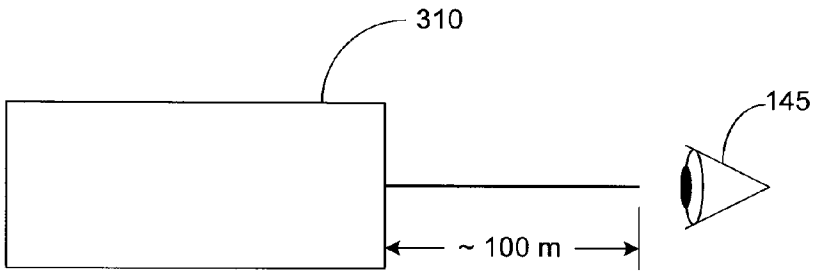
Figure 7C:
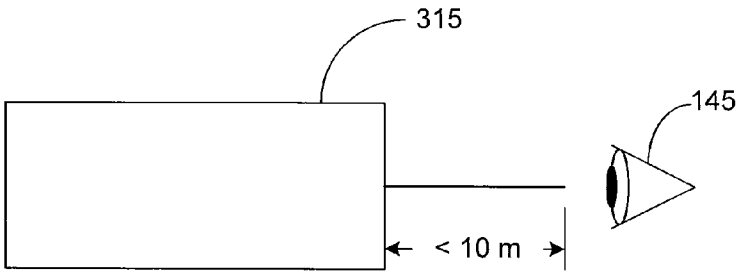

FIGS. 7A-7C are schematic diagrams showing example systems for propagating light to eyes at different distances. Specifically, FIG. 7A shows an example system for propagating light combined by the aforementioned techniques for a distance greater than 2 m. FIG. 7B and FIG. 7C show example systems for propagating the combined light for a distance of approximately 100 m and less than 10 m, respectively. For example, the example system shown in FIG. 7B can be operated to inhibit visual acuity of humans in a crowd. In such scenarios, the light sources can be operated in a continuous mode such that the optical beam produced by the light sources is moved like a spot light or flash light across the crowd. In such scenarios, the system can include an on-off switch to turn on and turn off the light sources. In alternative implementations, the system can be configured to transmit light as a sequence of light pulses.

The transmission units 305, 310, and 315 shown in FIG. 7A, FIG. 7B, and FIG. 7C, respectively, can be applied in different scenarios depending upon a distance of the eye 145 from the corresponding transmission unit. For example, the system shown in FIG. 7B can be applied for crowd control, while that shown in FIG. 7C can be applied in law enforcement.

In implementations in which the combined light is incident on the human eye, the irradiance of light produced by the transmission unit 112 is sufficient to alter visual acuity while preventing permanent damage to the eye. In some implementations, the visible light source can produce an optical beam having a spot size between 20 μm and 30 μm in a far field, for example, at a distance of 500 m. When the spot is incident on the eye, the small area of cones in the macula are saturated, thereby producing a glare that alters visual acuity. By mixing visible and infrared light of particular wavelengths, the retinal spot size of the visible optical beam can be enlarged.

The infrared wavelength acts as a carrier or "pump" that enters the eye and is significantly attenuated by absorption before reaching the retina. As the beam is absorbed according to Beer's Law, temperature gradients are formed, the largest of which are at the edge of the beam as it passes through the pupil.

Figure 8A:
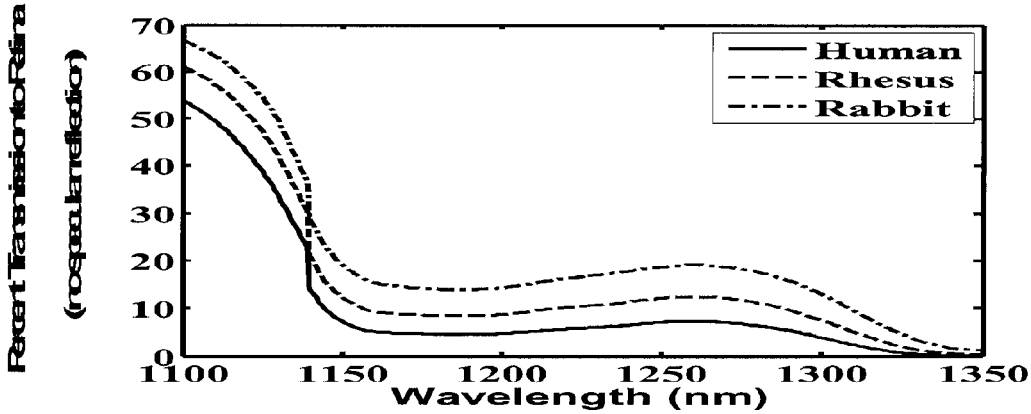
FIGS. 8A and 8B are plots showing percent transmission of infrared light to the retina over a range of infrared wavelengths in various types of eyes.
Figure 8B:
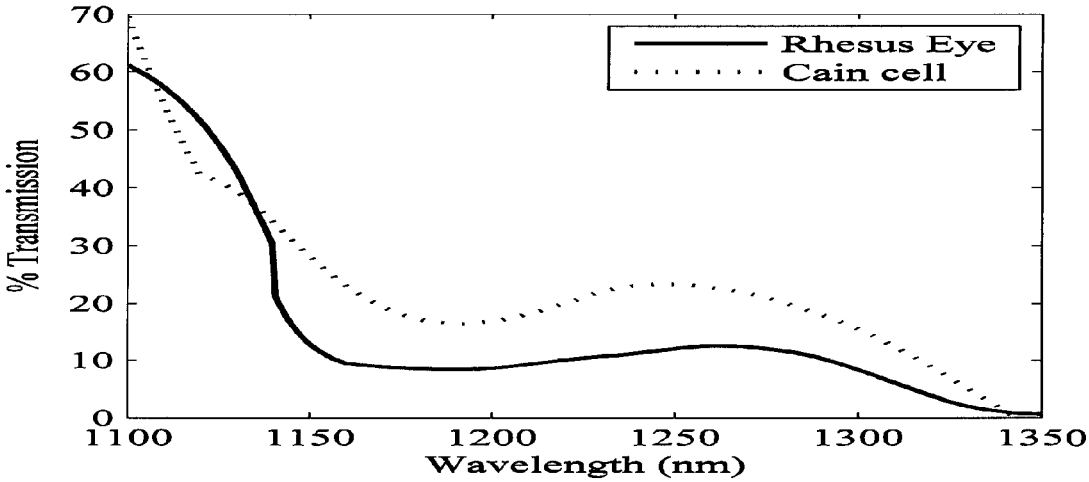

As described with reference to FIG. 12, Beer's law of attenuation can be applied to predict the percentage of light transmitted to the retina. The axial and radial thermal gradients produce local gradients in index of refraction. The radial gradients cause a divergence of the light entering the eye, thereby forming a virtual negative lens in the eye. As shown in FIGS. 8A and 8B, the wavelength of the infrared light affects the percent of light entering the cornea that is transmitted to the retina.

FIGS. 8A and 8B are plots showing percent transmission of infrared light to the retina over a range of infrared wavelengths in multiple types of eyes. FIG. 8A shows the transmission of infrared red light to the retina of a human eye, a rhesus eye, and a rabbit eye. The percent of transmission to the retina of the rhesus eye for wavelength from 1100 nm to 1350 nm shows that only a few percent of 1318 nm light reaches the retina. FIG. 8B additionally shows the transmission of infrared light in a Cain cell, which is an artificial eye that provides an optical model for the rhesus eye.

Figure 9A:
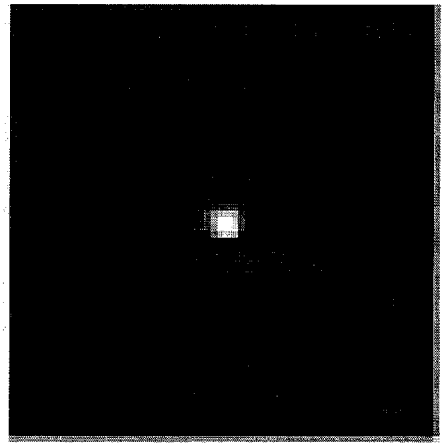
FIGS. 9A and 9B show spot sizes of a He—Ne laser beam.
Figure 9B:
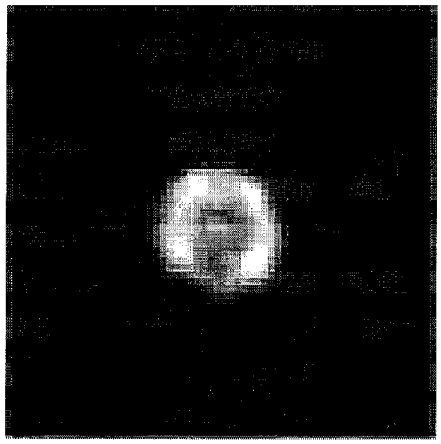

FIGS. 9A and 9B show spot sizes of a He—Ne laser beam. FIG. 9A shows the relative spot size on the retina when only visible light (wavelength—633 nm) is propagated to the eye. FIG. 9B shows the relative spot size on the retina when both visible light (wavelength—633 nm) and infrared light (wavelength—1318 nm) are propagated to the eye. As shown in FIG. 9B, when the infrared light is co-aligned with the visible light, the spot size on the retina increases. Further, as the retinal spot size increases, a larger portion of the macula is covered, thereby increasing a glare angle.

A glare angle is related to the portion of the eye on which the light is incident. For an eye, the glare angle represents an area on the retina where an image is masked by glare. For example, when incident light produces a glare angle of 1°, then the image subtended by the 1 degree solid angle at the retina can be masked by the glare. When the glare angle is increased to 30°, then most of the retinal image can be masked by glare.

Thus, when the visible light, for example, the laser beam, from the visible light source 110 is incident on the retina, it produces a spot size, for example, between 20 μm to 30 μm. When the infrared light, for example, another laser beam, from the infrared light source 105 is co-aligned with the visible light, and the co-aligned light is incident on the eye, then the spot size increases, for example, to approximately 100 μm greatly increases the glare angle.

In some scenarios, the power of the visible light or the infrared light or both can be adjusted such that the area of receptors covered by the visible beam is increased manifold, for example, by a factor of approximately 25. In some scenarios, the power of the visible light can remain constant, and the spot size can be adjusted by varying only the power of the infrared light source.

Therefore, when co-aligned light is incident on the eye, more photo receptors are saturated relative to when visible light alone is incident on the eye. Thus, the power required to power the visible light source 110, when the visible light is co-aligned with the infrared light, is less relative to the power required to power the visible light source 110 in the absence of co-alignment. Despite the decrease in power, the intended effect of altering visual acuity is obtained. Also, because the visible light spot size increases, damage caused to the eye is decreased, thereby enhancing safety. Furthermore, the change in refractive index of the medium anterior to the retina by the infrared light additionally alters visual acuity.

Figure 10:
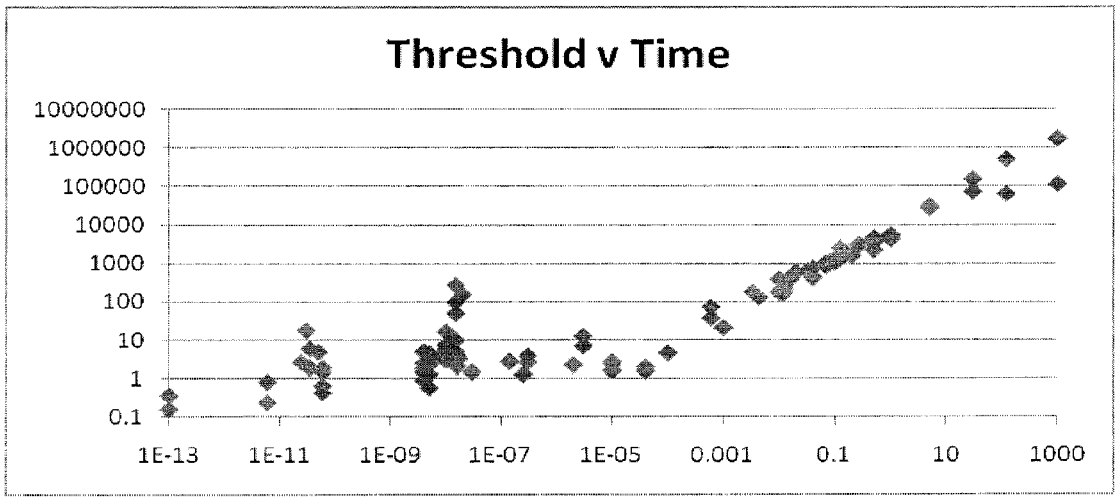
FIG. 10 is a plot of thresholds for visible light versus time.

FIG. 10 is a plot of thresholds for visible light versus time. The median effective radiant exposure (ED-50 radiant exposure $Q_{th}$) in micro Joules for wavelengths between 514.5 nm and 568.2 nm, plotted in FIG. 10, show that threshold energy values for light entering the eye correspond to retinal threshold powers of 10 mW entering the cornea for a 100 ms exposure and 5 mW for a 1 s exposure. Source powers that are safe for the eye at the position of the target may cause retinal injury near the transmission unit should the light be incident on the eye of a subject walking across the path of the propagated light. A transmission unit can be considered to be safe when the visible light irradiance, $E_s$ [W/cm$^2$], at the source multiplied by the pupil area, $A_p$, of the eye is less than the retinal ED-50 radiant threshold, $Q_{th}$ [J], divided by the exposure time, $t_p$ divided by a safety factor k which is typically equal to 10.0. Even if the accidental exposure is only 1.0 ms, safety can be improved if the ED-50 radiant exposure from FIG. 10 is below 80 μJ which corresponds to a source power of 80 mW for the 1.0 ms exposure.

Increasing the spot size of the visible light can increase the ED-50 threshold energy. In some scenarios, the infrared light can increase the retinal area of the visible spot, thereby increasing the threshold energy of the visible light by a factor of ten. In such scenarios, the 1 ms threshold for visible light increases from 80 μJ to 800 μJ. If retinal damage for the 1 ms exposure can be avoided everywhere in the beam, then the light source can be powered off before damage to the retina The reduction in time to cut off the visible laser or an increase in source size can improve the safety factor and provide more visible energy to the target.

In some implementations, the system 100 can include a range finder configured to track the target and alter power of the visible light and the laser light to maintain safety. The transmission unit 112 can be operatively coupled to the range finder such that, when a subject interferes with the path of the visible light, the range finder determines a distance between the interfering subject and the transmission unit 112, and if the safety limits are exceeded and either decreases or turns off the power to the light sources. Alternatively, or in addition, the range finder can decrease or turn off the power to the light sources upon detecting that the subject interferes with the path of the propagated light. Further, the range finder (or alternatively, the transmission unit 112) can include a timer that maintains the power provided to the light source 105 or the light source 110 or both for a specified duration. The timer can be used to propagate the co-aligned light for the specified duration. In some implementations, the range finder can be implemented in processing circuitry. The ED-50 radiant thresholds and safety factor k can be stored on a computer-readable medium and operatively coupled to the processing circuitry.

Figure 12:
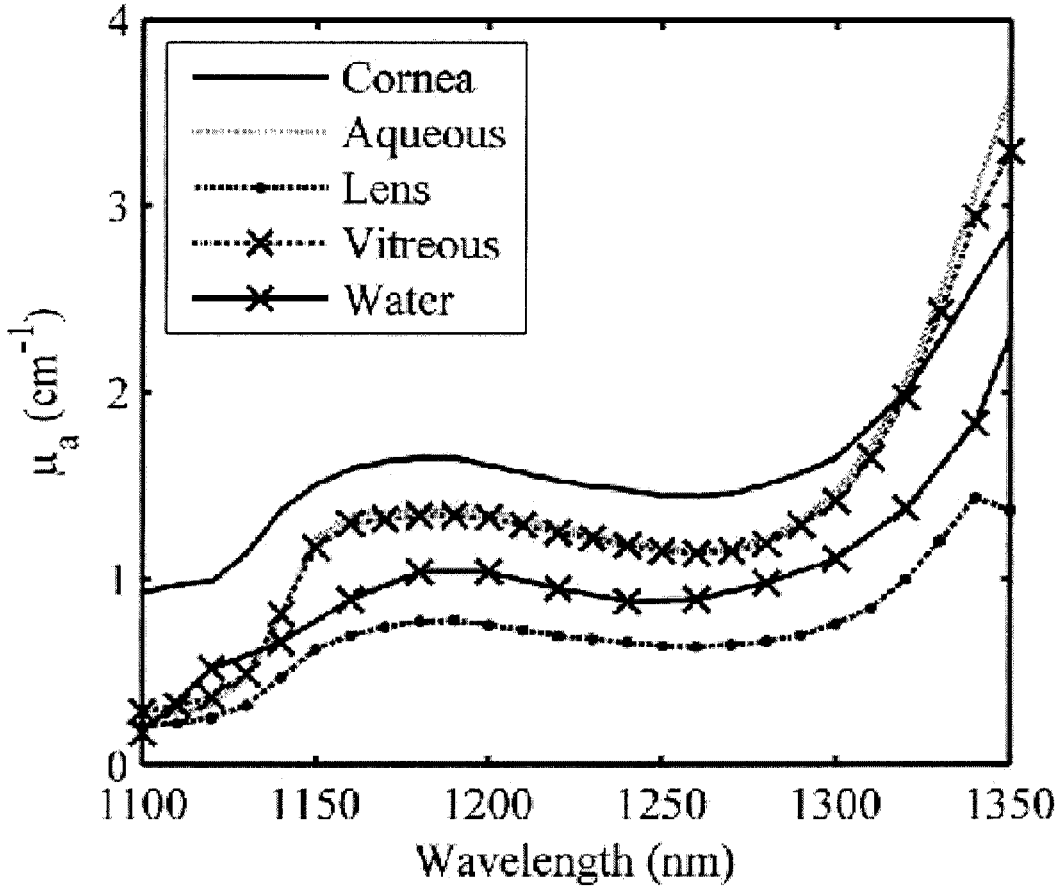
FIG. 12 is a plot of absorption of light in various components of an eye, and in water, over a range of wavelengths.

FIG. 12 is a plot of absorption of light in various components of an eye, and in water, over a range of wavelengths. The absorption values in the various eye components follow that for water closely. The plot in FIG. 12 shows that Beer's law of attenuation can be applied to predict the percentage of light transmitted to the retina if physiological data are considered along with the linear absorption coefficients.

In some implementations, the system 100 can be operated such that only infrared light, and no visible light, is propagated to the eye. In such implementations, the system 100 can be employed as a stealth system. For example, when the system is operated only with infrared light, i.e., when infrared light alone is propagated to the eye, visual acuity is altered, i.e., distorted, because of the changes in index of refraction in the eye. Not only can the vision of the eye be blurred but also the safety of the eye can be increased in both near and far field.

In implementations in which only infrared light and no visible light is used, the index of refraction of system 100 remains unaffected by day light. Because the amount of light entering the eye is determined by the irradiance ($W/cm^2$), at the target, and the pupil area, which is a function of ambient light level. By adjusting the power provided to the infrared light source 105, visual acuity induced in the eye during the day by the infrared source can be similar to that induced at night.

Figure 13:
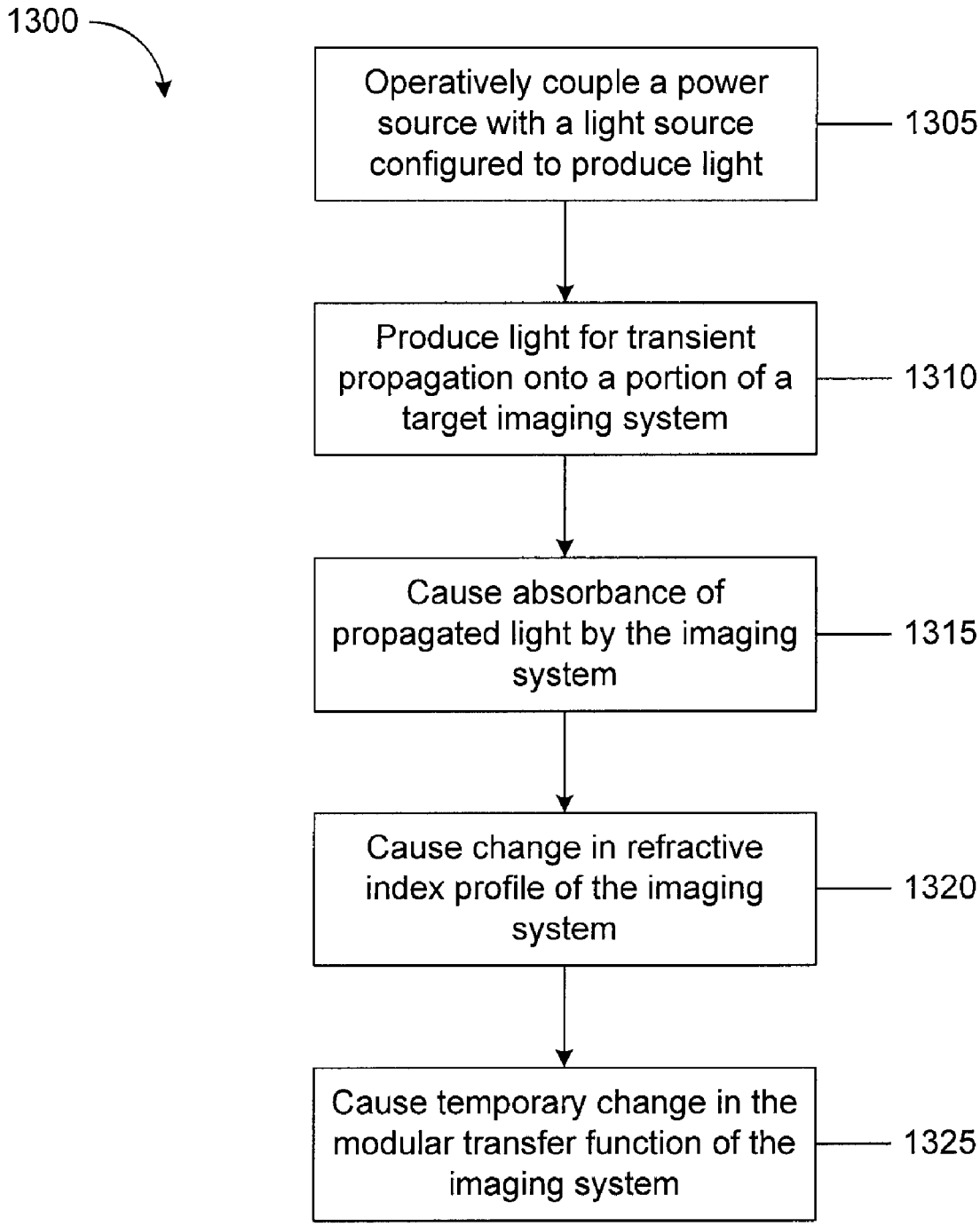
FIG. 13 is a flowchart of an example process for changing modular transfer function of an imaging system.

FIG. 13 is a flowchart of an example process 1300 for changing modular transfer function of an imaging system. The modular transfer function (MTF) is a measure of the capability of an imaging system, for example, the eye, to reproduce an image of an object. The process 1300 operatively couples a power source with a light source configured to produce light (step 1305). For example, a power source is operatively coupled with a laser light source and configured to effect the production of light from the light source. The process 1300 produces light for transient propagation onto a portion of a target imaging system (step 1310). For example, a light source such as a laser light source is operable to produce light for transient propagation onto at least a portion of the target imaging system. The process 1300 causes absorbance of propagated light by the imaging system (step 1315). For example, an optical system in operative communication with the light source propagates the produced light onto at least a portion of the target imaging system. The propagated light is configured for absorbance by the portion of the target imaging system, for example, the eye. The process 1300 causes change in refractive index profile of the imaging system (step 1320). For example, the absorbance causes an increase in temperature and a change in a refractive index profile of the eye. The process 1300 causes temporary change in the MTF of the imaging system (step 1325).

Figure 14:
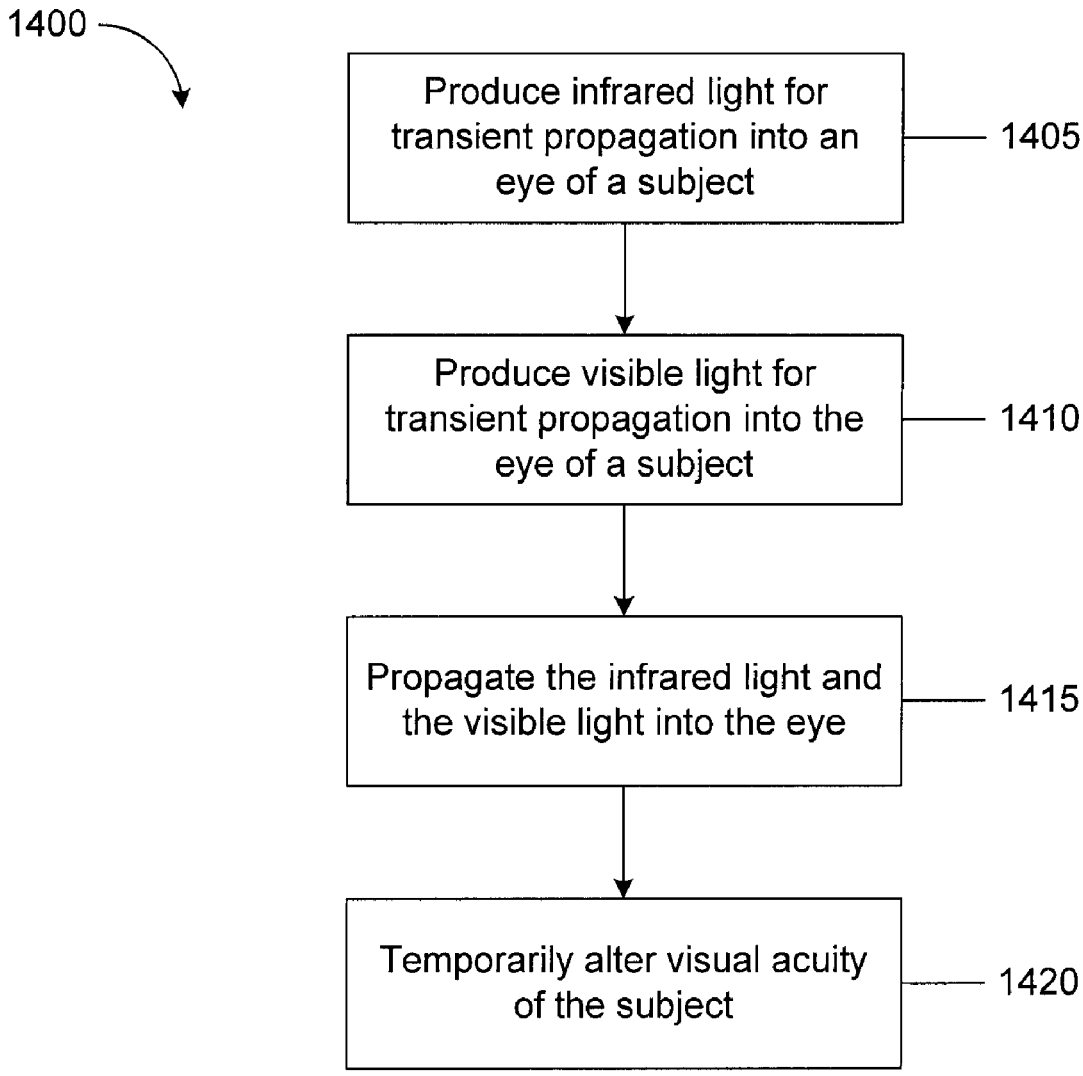
FIG. 14 is a flowchart of an example process to temporarily alter visual acuity of a subject.

FIG. 14 is a flowchart of an example process 1400 to temporarily alter visual acuity of a subject. The process 1400 produces infrared light in an infrared wavelength spectrum for transient propagation into an eye of the subject (step 1405). For example, an infrared light-generating laser light source produces the infrared light which is propagated to the eye t. The process 1400 produces visible light in a visible wavelength spectrum for transient propagation into the eye of the subject (step 1410). For example, a visible light-generating laser light source produces the visible light which is propagated to the eye. The process 1400 propagates the infrared light and the visible light into the eye (step 1415). For example, a transmission unit propagates the light into the eye. To do so, in some implementations, the transmission unit includes an optical system that co-aligns the infrared light and the visible light, and propagates the co-aligned light into the eye. The process 1400 temporarily alters visual acuity of the subject (step 1420).

Figure 15:
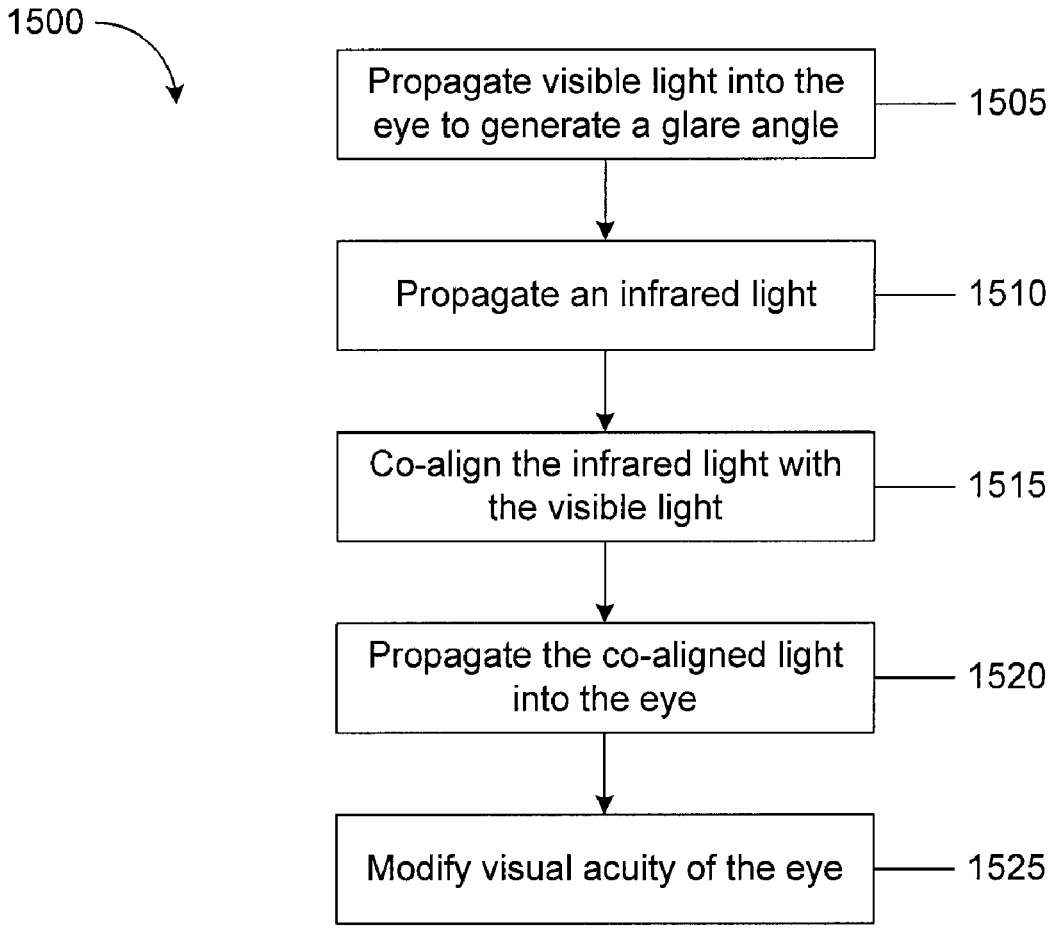
FIG. 15 is a flowchart of an example process to modify visible light.

FIG. 15 is a flowchart of an example process 1500 to modify visible light. The process 1500 propagates visible light into the eye to generate a glare angle (step 1505). The process 1500 modifies the visible light. To do so, the process 1500 propagates an infrared light (step 1510) and co-aligns the infrared light with the visible light (step 1515). The process 1500 propagates the co-aligned light into the eye (step 1520), and thereby modifies visual acuity of the eye (step 1525). For example, the visible light-generating laser source propagates light of sufficient irradiance to saturate the photo receptors in an area of the eye. The infrared light-generating laser source generates light of sufficient irradiance to generate temperature gradients in the region of the eye on which the light is incident. The temperature gradients cause a change in the refractive index profile of the region, thereby de-focusing images formed in the eye. The transmission unit co-aligns the visible light and the infrared light; the presence of the infrared light in the co-aligned light increases a spot size of the co-aligned light. The light of increased spot size occupies a greater area in the eye relative to the area occupied when visible light alone is propagated. Not only does the visual acuity of the eye further inhibited but also a laser power of the visible laser light is decreased thereby decreasing the potential for permanent damage to the eye.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

What is claimed is:

1. A system operable to effect a temporary change in a modulation transfer function (MTF) of a target imaging system, comprising:

a light source operable to produce light for transient propagation onto at least a portion of the target imaging system;

a power source in operative communication with the light source and configured to effect the production of light from the light source; and a transmission unit in operative communication with the light source and configured to propagate the produced light onto at least a portion of the target imaging system, wherein the propagated light is configured for absorbance by the portion of the target imaging system;

the absorbance causing an increase in temperature and a change in a refractive index profile of at least the portion of the imaging system, the change in refractive index profile producing a temporary change in the MTF of the imaging system.

2. The system of claim 1, wherein the propagated light has a wavelength in the range of 1100 nanometers (nm) to 2500 (nm).

3. The system of claim 1, wherein the imaging system is an eye.

4. The system of claim 3, wherein the portion of eye that absorbs the light is anterior to the retina.

5. The system of claim 4, wherein the portion of the eye that absorbs the light is selected from the group consisting of the vitreous humor, the lens, the aqueous humor, and the cornea.

6. The system of claim 5, wherein the absorption of light causes a non-uniform index of refraction change in the cornea, aqueous humor, lens or vitreous humor.

7. The system of claim 3, wherein the portion of the eye that absorbs the light is the retina or tissue posterior to the retina.

8. The system of claim 3, wherein the absorption of light disrupts visual acuity.

9. The system of claim 3, wherein the eye is a human eye.

10. The system of claim 9, wherein an irradiance of the propagated light at a location where the target imaging system receives the propagated light is between 0.001 $W/cm^2$ and 500 $W/cm^2$.

11. The system of claim 9, wherein an irradiance of the propagated light at a location where the target imaging system receives the propagated light is between 0.005 $W/cm^2$ and 50 $W/cm^2$.

12. The system of claim 9, wherein an irradiance of the propagated light at a location where the target imaging system receives the propagated light is between 0.1 $W/cm^2$ and 5 $W/cm^2$.

13. The system of claim 1, wherein the light source is a first laser light source.

14. The system of claim 1, further comprising a second light source operable to produce light for transient propagation onto at least a portion of the target imaging system.

15. The system of claim 14, wherein the transmission unit is in operative communication with the second light source and is configured to propagate light produced by the second light source onto at least a portion of the target imaging system.

16. The system of claim 15, wherein the propagated light from the second light source has a wavelength in the range of 450 nm to 650 nm.

17. The system of claim 15, wherein the transmission unit is operable to co-align light from the first and second light sources for propagation onto at least a portion of the target.

18. The system of claim 14, wherein an irradiance of light from the second light source at a location where the target imaging system receives the propagated light is greater than 0.001 $mW/cm^2$.

19. The system of claim 1, wherein the propagated light has a wavelength in the range of 1100 nm to 2500 nm and wherein the system further comprises a second light source operable to produce light for transient propagation onto at least a portion of the target imaging system, wherein the propagated light from the second light source has a wavelength in the range of 450 nm to 650 nm.

* * * * *